US010077646B2

(12) United States Patent
Joshi et al.

(10) Patent No.: US 10,077,646 B2
(45) Date of Patent: Sep. 18, 2018

(54) CLOSED LOOP HYDROCARBON EXTRACTION SYSTEM AND A METHOD FOR OPERATING THE SAME

(71) Applicant: General Electric Company, Schenectady, NY (US)

(72) Inventors: Mahendra L Joshi, Katy, TX (US); Xuele Qi, Edmond, OK (US); Raymond Patrick Murphy, Waddell, AZ (US); Stewart Blake Brazil, Edmond, OK (US); Haifeng Jiang, Edmond, OK (US); Dewey Lavonne Parkey, Oklahoma City, OK (US); Victor Jose Acacio, Houston, TX (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 361 days.

(21) Appl. No.: 14/975,915

(22) Filed: Dec. 21, 2015

(65) Prior Publication Data

US 2017/0022795 A1 Jan. 26, 2017

Related U.S. Application Data

(60) Provisional application No. 62/195,814, filed on Jul. 23, 2015.

(51) Int. Cl.
*E21B 43/38* (2006.01)
*E21B 43/40* (2006.01)
(Continued)

(52) U.S. Cl.
CPC ..... *E21B 43/38* (2013.01); *E21B 43/128* (2013.01); *E21B 43/129* (2013.01); *E21B 43/40* (2013.01); *E21B 47/00* (2013.01); *E21B 49/08* (2013.01)

(58) Field of Classification Search
None
See application file for complete search history.

(56) References Cited

U.S. PATENT DOCUMENTS 4,296,810 A 10/1981 Price
4,913,630 A 4/1990 Cotherman et al.
(Continued)

FOREIGN PATENT DOCUMENTS

CA 2096888 A1 11/1993
CN 202417467 U 9/2012
(Continued)

OTHER PUBLICATIONS

Matthews et al., "Application of Downhole Oil/Water Separation Systems in the Alliance Field", SPE Health, Safety and Environment in Oil and Gas Exploration and Production Conference, New Orleans, Louisiana, vol. No. 1, pp. 453-462, Jun. 9-12, 1996.
(Continued)

*Primary Examiner* — Matthew R Buck
*Assistant Examiner* — Douglas S Wood
(74) *Attorney, Agent, or Firm* — GE Global Patent Operation; Pabitra Chakrabarti

(57) ABSTRACT

A system includes a downhole rotary separator located within the well formation and configured to generate a hydrocarbon rich stream and a first water stream from a well fluid obtained from a production zone. The system also includes an electrical submersible pump disposed within the well formation and operatively coupled to the downhole rotary separator, wherein the electrical submersible pump is configured to transfer the hydrocarbon rich stream to a surface of the earth. The system further includes a surface separator located on the surface of earth and operatively coupled to generate oil and a second water stream from the hydrocarbon rich stream. The system also includes a hydrau-
(Continued)

lic motor disposed within the well formation and operatively coupled to the downhole rotary separator, wherein the hydraulic motor is configured to drive the downhole rotary separator using a drive fluid comprising the hydrocarbon rich stream or the second water stream.

18 Claims, 3 Drawing Sheets

(51) Int. Cl.

| | |
|---|---|
| ***E21B 47/00*** | (2012.01) |
| ***E21B 49/08*** | (2006.01) |
| ***E21B 43/12*** | (2006.01) |

(56) References Cited

U.S. PATENT DOCUMENTS

| | | | | |
|---|---|---|---|---|
| 5,318,122 | A | 6/1994 | Murray et al. | |
| 5,423,387 | A | 6/1995 | Lynde | |
| 5,830,368 | A | 11/1998 | Peachey | |
| 5,857,519 | A | 1/1999 | Bowlin et al. | |
| 5,862,863 | A | 1/1999 | Swisher | |
| 5,965,086 | A | 10/1999 | Rose et al. | |
| 5,992,524 | A | 11/1999 | Graham | |
| 5,996,690 | A * | 12/1999 | Shaw | B04C 11/00 166/250.01 |
| 6,015,011 | A | 1/2000 | Hunter | |
| 6,033,567 | A | 3/2000 | Lee et al. | |
| 6,039,116 | A | 3/2000 | Stevenson et al. | |
| 6,068,053 | A | 5/2000 | Shaw | |
| 6,070,661 | A | 6/2000 | Kennedy et al. | |
| 6,070,667 | A | 6/2000 | Gano | |
| 6,080,312 | A | 6/2000 | Bowers et al. | |
| 6,082,452 | A | 7/2000 | Shaw et al. | |
| 6,131,655 | A | 10/2000 | Shaw | |
| 6,173,774 | B1 | 1/2001 | Fox | |
| 6,189,613 | B1 | 2/2001 | Chachula et al. | |
| 6,189,616 | B1 | 2/2001 | Gano et al. | |
| 6,196,313 | B1 | 3/2001 | Simons | |
| 6,209,641 | B1 * | 4/2001 | Stevenson | E21B 43/124 166/105.5 |
| 6,336,504 | B1 | 1/2002 | Alhanati et al. | |
| 6,457,522 | B1 * | 10/2002 | Bangash | E21B 43/128 166/105.5 |
| 6,547,003 | B1 | 4/2003 | Bangash et al. | |
| 6,845,821 | B2 | 1/2005 | Bouma et al. | |
| 7,093,661 | B2 * | 8/2006 | Olsen | E21B 37/00 166/266 |
| 7,147,788 | B2 | 12/2006 | Tveiten | |
| 7,420,183 | B2 | 9/2008 | Kaiser et al. | |
| 7,610,961 | B2 | 11/2009 | Manin et al. | |
| 8,261,821 | B2 | 9/2012 | Hackworth et al. | |
| 8,327,941 | B2 | 12/2012 | Hackworth et al. | |
| 8,449,750 | B2 | 5/2013 | Hamid et al. | |
| 8,757,256 | B2 | 6/2014 | Li et al. | |
| 8,997,870 | B2 | 4/2015 | McAllister et al. | |
| 2001/0047872 | A1 | 12/2001 | Roberts et al. | |
| 2002/0189807 | A1 | 12/2002 | Emanuele et al. | |
| 2004/0062140 | A1 | 4/2004 | Cadogan et al. | |
| 2010/0147511 | A1 | 6/2010 | Ollre | |
| 2011/0079388 | A1 | 4/2011 | Cox | |
| 2011/0087476 | A1 | 4/2011 | Calvert et al. | |
| 2015/0218501 | A1 | 8/2015 | Kauling et al. | |
| 2017/0022761 | A1 | 1/2017 | Joshi et al. | |
| 2017/0022796 | A1 | 1/2017 | Joshi et al. | |
| 2017/0022797 | A1 | 1/2017 | Joshi et al. | |

FOREIGN PATENT DOCUMENTS

| | | | |
|---|---|---|---|
| EP | 0571771 | A2 | 12/1993 |
| WO | 2005118771 | A2 | 12/2005 |
| WO | 2012005889 | A1 | 1/2012 |
| WO | 2014044612 | A1 | 3/2014 |
| WO | 2014058426 | A1 | 4/2014 |

OTHER PUBLICATIONS

Loginov et al., "Completion Design for Downhole Water and Oil Separation and Invert Coning", SPE Annual Technical Conference and Exhibition, San Antonio, Texas, pp. 801-810, Oct. 5-8, 1997.
Bowers et al., "Development of a Downhole Oil/water Separation and Reinjection System for Offshore Application", Offshore Technology Conference, Houston, Texas, vol. No. 15, Issue No. 2, pp. 115-122, May 2000.
Alhoni et al., "Application of Downhole Oil-Water Separation: A Feasibility Study", SPE Asia Pacific Oil and Gas Conference and Exhibition, Jakarta, Indonesia, pp. 1-12, 2003.
Harding et al., "Horizontal Water Disposal Well Performance in a High Porosity and Permeability Reservoir", Journal of Canadian Petroleum Technology, vol. No. 43, Issue No. 11, pp. 21-31, Nov. 2004.
Qazi et al., "A neural network model predicting combined separation efficiency of compact axial cyclonic and gravity separator", Computer, Control and Communication, IC4, 2nd International Conference, Karachi, pp. 1-7, Feb. 17-18, 2009.
Zunce et al., "Study on the Flow Pattern of Downhole Oil-Water Separator with Different Inlet Patterns", Bioinformatics and Biomedical Engineering, ICBBE, 3rd International Conference, Beijing, pp. 1-4, Jun. 11-13, 2009.
International Search Report and Written Opinion issued in connection with corresponding PCT Application No. EP2016/057971 dated Jun. 10, 2016.
International Search Report and Written Opinion issued in connection with corresponding PCT Application No. PCT/US2016/038284 dated Aug. 30, 2016.
PCT Search Report and Written Opinion issued in connection with related PCT Application No. PCT/US2016/042005 dated Oct. 5, 2016.
PCT Search Report and Written Opinion issued in connection with related PCT Application No. PCT/US2016/041439 dated Oct. 13, 2016.
PCT Search Report and Written Opinion issued in connection with related PCT Application No. PCT/US2016/042907 dated Oct. 13, 2016.
Mahendra Ladharam Joshi et al., Jun. 27, 2016, U.S. Appl. No. 15/193,392.
Mahendra Ladharam Joshi et al., Jun. 29, 2016, U.S. Appl. No. 15/196,737.
Mahendra L. Joshi et al., Dec. 14, 2015, U.S. Appl. No. 14/968,292.
Richard Lee Damren et al., Apr. 20, 2015, U.S. Appl. No. 62/149,813.
T. Kjos et al., "Down-Hole Water-Oil Separation and Water Reinjection Through Well Branches", SPE Annual Technical Conference and Exhibition, Dallas, Texas, 1995. 15 Pages.
Jerbeek et al., "Downhole Separator Produces Less Water and More Oil", European Petroleum Conference, The Hague, Netherlands, 1998; 8 Pages.
U.S. Appl. No. 15/561,826 Filed on Sep. 26, 2017.

* cited by examiner

CLOSED LOOP HYDROCARBON EXTRACTION SYSTEM AND A METHOD FOR OPERATING THE SAME

CROSS-REFERENCE TO RELATED APPLICATIONS

This application claims the priority and benefit of U.S. Provisional Application No. 62/195,814 entitled "SYSTEM AND METHOD FOR WELL PARTITION AND DOWNHOLE SEPARATION OF WELL FLUIDS" filed on Jul. 23, 2015, which is incorporated herein by reference in its entirety.

BACKGROUND

Embodiments of the present invention relate to hydrocarbon extraction systems, and more particularly to a closed loop hydrocarbon extraction system and method of operating the same.

Non-renewable hydrocarbon fluids such as oil and gas are used widely in various applications for generating energy. Such hydrocarbon fluids are extracted from the hydrocarbon extraction wells, which extend below the surface of the earth to a region where the hydrocarbon fluids are available. The hydrocarbon fluids are not available in a purified form and are available as a mixture of hydrocarbon fluids, water, sand, and other particulate matter referred to as a well fluid. Such well fluids are filtered using different mechanisms to extract a hydrocarbon rich stream and a water stream.

In one approach, the well fluids are extracted to the surface of the earth and then separated on the surface of the earth, using a surface separator. In another approach, the well fluids are separated within the well formation, using a downhole separator. The water separated from the well fluids, is disposed at a central water disposal location. However, such an approach increases risk of seismic activity in the particular geographical location.

In some other approaches involving the downhole separator, the water stream separated from the hydrocarbon rich stream, is disposed within the same well formation. In such approaches, the downhole separator is coupled to an electric drive motor. Operation of such a configuration increases electric power consumption leading to additional costs. Moreover, such a downhole separator is susceptible to scaling leading to reduction in efficiency of the downhole separator. Furthermore, the flow pressure of the well fluids reduces over a period of time. Such reduction of flow pressure creates operational issues with an electrical submersible pump which is used to transfer the hydrocarbon rich stream to the surface of earth.

BRIEF DESCRIPTION

Briefly, in accordance with one embodiment, a system for extracting hydrocarbon rich stream from a well formation is provided. The system includes a downhole rotary separator located within the well formation and configured to generate a hydrocarbon rich stream and a first water stream from a well fluid obtained from a production zone. The system also includes an electrical submersible pump disposed within the well formation and operatively coupled to the downhole rotary separator, wherein the electrical submersible pump is configured to transfer the hydrocarbon rich stream to a surface of the earth. The system further includes a surface separator located on the surface of earth and operatively coupled to generate oil and a second water stream from the hydrocarbon rich stream. The system also includes a hydraulic motor disposed within the well formation and operatively coupled to the downhole rotary separator, wherein the hydraulic motor is configured to drive the downhole rotary separator using a drive fluid, wherein the drive fluid comprises the hydrocarbon rich stream or the second water stream.

In another embodiment, a method for extracting hydrocarbons from a well formation is provided. The method includes transferring a well fluid from a production zone to a downhole rotary separator. The method also includes centrifugally separating the well fluid to generate a hydrocarbon rich stream and a first water stream using the downhole rotary separator. The method further includes transferring the hydrocarbon rich stream to a surface of the earth using an electrical submersible pump. The method also includes separating the hydrocarbon rich stream to generate oil and a second water stream. The method further includes operating a hydraulic motor configured to drive the downhole rotary separator using the second water stream or the hydrocarbon rich stream.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Embodiments of the present invention include a system and a method for extracting hydrocarbon rich stream from a well formation. The system includes a downhole rotary separator located within the well formation and configured to generate a hydrocarbon rich stream and a first water stream from a well fluid obtained from a production zone. The system also includes an electrical submersible pump disposed within the well formation and operatively coupled to the downhole rotary separator, wherein the electrical submersible pump is configured to transfer the hydrocarbon rich stream to a surface of the earth. The system further includes a surface separator located on the surface of earth and operatively coupled to generate oil and a second water stream from the hydrocarbon rich stream. The system also includes a hydraulic motor disposed within the well formation and operatively coupled to the downhole rotary separator, wherein the hydraulic motor is configured to drive the downhole rotary separator using a drive fluid, wherein the drive fluid comprises the hydrocarbon rich stream or the second water stream.

Figure 1:
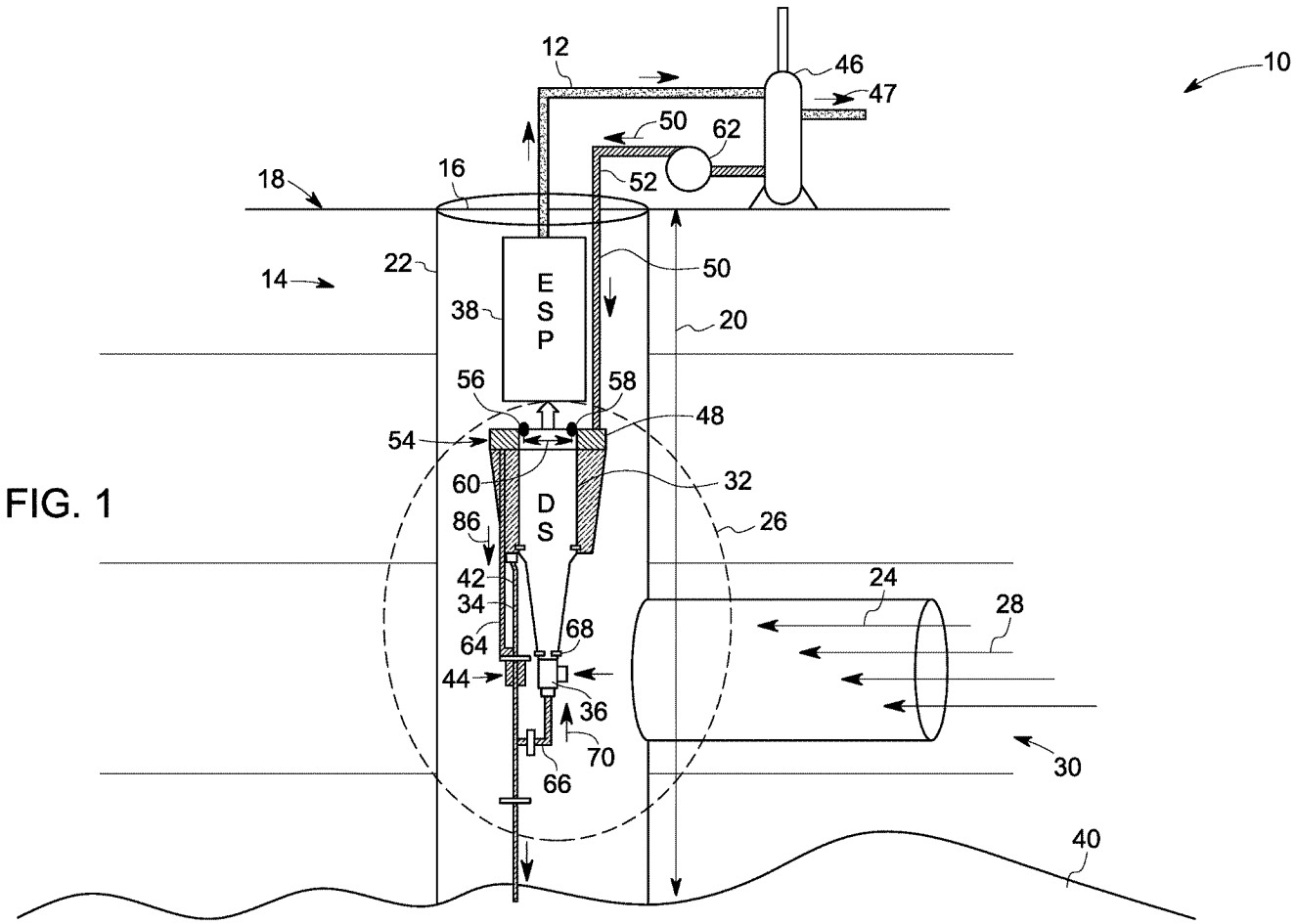
FIG. 1 is a schematic representation of a system for extracting a hydrocarbon rich stream from a well formation in accordance with an embodiment of the invention.

FIG. 1 is a schematic representation of a system 10 for extracting hydrocarbon rich stream 12 from a well formation 14 in accordance with an embodiment of the invention. The well formation 14 includes a well bore 16 drilled from a surface 18 of the earth. The well bore 16 extends upto a predetermined depth 20 to form a vertical leg 22. The well formation 14 also includes a lateral leg 24 which is coupled to the vertical leg 22 via a leg junction 26. The lateral leg 24 is configured to receive a well fluid 28 from a production zone 30. The hydrocarbon rich stream 12 is extracted from the well fluid 28.

The system 10 further includes a downhole rotary separator 32 located within the well formation 14. In the illustrated embodiment, the downhole rotary separator 32 is located within the vertical leg 22 of the well formation 14. The downhole rotary separator 32 is configured to receive the well fluid 28 from the production zone 30 via the lateral leg 24 and generate the hydrocarbon rich stream 12 and a first water stream 34 from the well fluid 28. In one embodiment, the downhole rotary separator 32 may be a centrifugal separator. The downhole rotary separator 32 is discussed in greater detail with reference to later part of the specification.

The system 10 further includes a jet pump 36 operatively coupled to the downhole rotary separator 32. The jet pump 36 is configured to transfer the well fluid 28 from the lateral leg 24 to the downhole rotary separator 32. In some embodiments, the jet pump 36 may be used to pressurize the well fluid 28 prior to introducing the well fluid 28 to the downhole rotary separator 32 to improve efficiency of the system 10.

The system 10 further includes an electrical submersible pump (ESP) disposed within the well formation 14. In the illustrated embodiment, the ESP 38 is located above the downhole rotary separator 32 in the vertical leg 22. The ESP 38 is operatively coupled to the downhole rotary separator 32 and is configured to receive the separated hydrocarbon rich stream 12 from the downhole rotary separator 32. The ESP 38 is further to transfer the hydrocarbon rich stream 12 to the surface 18 of the earth.

The system 10 further includes a first water stream tubing 42 which is operatively coupled to the downhole rotary separator 32. The first water stream tubing 42 is configured to receive the separated first water stream 34 from the downhole rotary separator 32 and transfer the first water stream 34 to a subterranean water disposal zone 40. Further, a booster pump 44 is operatively coupled to the first water stream tubing 42. The booster pump 44 is configured to increase pressure of the first water stream 34 while disposing the first water stream 34 to the subterranean water disposal zone 40. Water disposal efficiency of the system 10 is enhanced by increasing the pressure of the first water stream 34 during disposal. In some embodiments, the system 10 may include a distributed subterranean water disposal zone (not shown). The distributed subterranean water disposal zone may include one or more lateral disposal legs which may be used for disposing the first water stream 34 in a distributed manner. In such embodiments, the booster pump 44 is configured to increase the pressure of the first water stream 34 to enable forceful disposal of water to the distributed subterranean water disposal zone 40 via the one or more lateral disposal legs.

The system 10 also includes a surface separator 46 located on the surface 18 of the earth. The surface separator 46 is operatively coupled to the ESP 38 and is configured to receive the hydrocarbon rich stream 12 from the ESP 38. The surface separator 46 is further configured to generate oil 47 and a second water stream 50 from the hydrocarbon rich stream 12. The oil 47 generated from the hydrocarbon rich stream 12, is transported to a desired location. Further, a second water stream tubing 52 is operatively coupled to the surface separator 46. The second water stream 50 is transferred back to the well formation 14 for disposal via the second water stream tubing 52.

The system 10 also includes a hydraulic motor 48 disposed within the well formation 14. In the illustrated embodiment, the hydraulic motor 48 is disposed above the downhole rotary separator 32. The hydraulic motor 48 is operatively coupled to the downhole rotary separator 32 and is configured to drive the downhole rotary separator 32, using a drive fluid 54. In the illustrated embodiment, the drive fluid 54 includes the second water stream 50. In such embodiments, the second water stream tubing 52 is operatively coupled to the surface separator 46 and the hydraulic motor 48. The second water stream tubing 52 is configured to transfer the second water stream 50 from the surface separator 46 to the hydraulic motor 48.

In embodiments where the downhole rotary separator 32 includes the centrifugal separator, the hydraulic motor 48 is configured to rotate the centrifugal separator at a predetermined speed to separate the well fluid 28 and generate the hydrocarbon rich stream 12 and the first water stream 34. During rotation of the centrifugal separator, hydrocarbons having a lower molecular weight are separated from water and other particulate matter having a higher molecular weight in the well fluid 28. The hydrocarbons separated from the well fluid 28 form the hydrocarbon rich stream 12. The hydrocarbon rich stream 12 is transferred to the surface separator 46 using the ESP 38. In some embodiments, a rod pump may be used instead of the ESP 38. The water and other particulate matter such as sand form the first water stream 34 which is transferred to the subterranean water disposal zone 40.

The system 10 further includes a first sensor 56 and a second sensor 58 operatively coupled to an outlet 60 of the downhole rotary separator 32. The first sensor 56 is configured to determine water content in the hydrocarbon rich stream 12 transferred to the ESP 38. The second sensor 58 is configured to determine a flow rate of the hydrocarbon rich stream 12 transferred to the ESP 38. In another embodiment, a single sensor may be used to determine the water content in the hydrocarbon rich stream 12 and the flow rate of the hydrocarbon rich stream 12. The system 10 further includes a control valve 62 located on the surface 18 of the earth. In one embodiment, the control valve 62 may include a hydraulic choke valve or an electronic regulator. The control valve 62 is used to control the speed of the hydraulic motor 48 based on output from at least one of the first sensor 56 and the second sensor 58. The control valve 62 is configured to control a pressure and a flow rate of the second water stream 50 that is used to drive the hydraulic motor 48. To this end, the output from the at least one of the first sensor 56 and the second sensor 58 is transmitted to a processing unit (not shown), which generates set points for the control valve 62 based on the output from the at least one of the first sensor 56 and the second sensor 58. The set points from the processing unit are transmitted to the control valve 62 based on which the control valve 62 controls the speed of the hydraulic motor 48. In one embodiment, the processing unit may include a proportional-integral-derivative (PID) controller, which may be integrated within the control valve 62. Furthermore, the control valve 62 may control a separation efficiency of the downhole rotary separator 32 based on such set points. As a result, the control valve 62 may be used for controlling a water content in the hydrocarbon rich stream 12, which in turn enables the control valve 62 to maintain a constant load for the ESP 38, thereby controlling an operational range of the ESP 38.

An exhaust water tubing 64 is operatively coupled to the hydraulic motor 48 and the first water stream tubing 42. The exhaust water tubing 64 is used to receive the second water stream 50 from the hydraulic motor 48 and transfer the second water stream 50 to the first water stream tubing 42. The second water stream 50 is combined with the first water stream 34 prior to disposing in the subterranean water disposal zone 40. A motive fluid tubing 66 is provided to connect the first water stream tubing 42 and the exhaust water tubing 64 to an inlet 68 of the downhole rotary separator 32. Further, a jet pump 36 is coupled to the motive fluid tubing 66. In such embodiments, different substances may be added to the second water stream 50 prior to transferring the second water stream 50 to the hydraulic motor 48, for improving efficiency and reducing maintenance costs. In one example, anti-scaling chemicals may be added to the second water stream 50 prior to transferring the second water stream 50 to the hydraulic motor 48. The second water stream 50 including the anti-scaling chemicals is used to drive the hydraulic motor 48. The second water stream 50 is further transferred to the downhole rotary separator 32, as a motive fluid 70, via the motive fluid tubing 66. Such a configuration enables cleaning of the downhole rotary separator 32 by reducing scaling in the downhole rotary separator 32.

Figure 2:
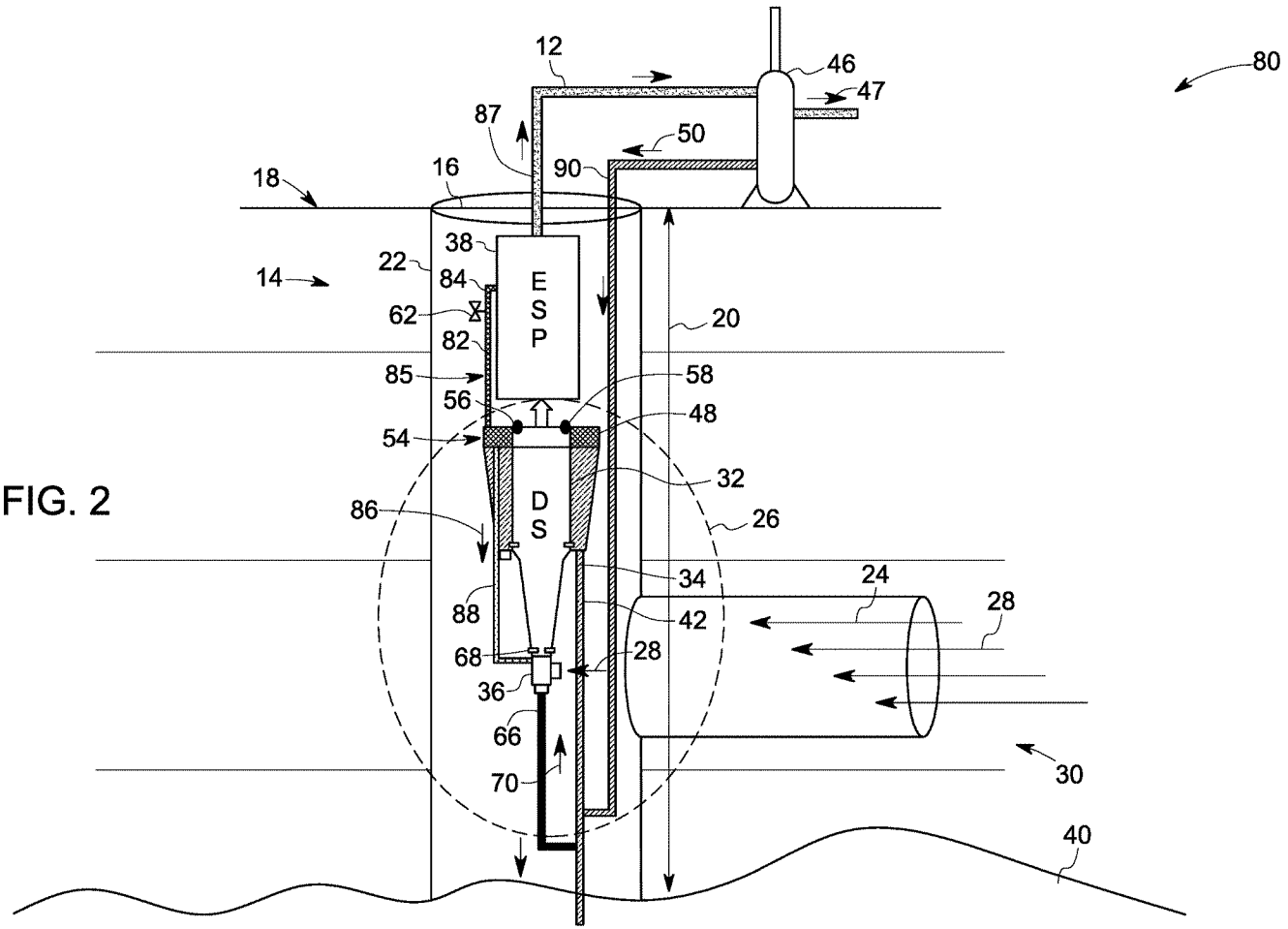
FIG. 2 is a schematic representation of a system for extraction hydrocarbon rich stream from a well formation in accordance with another embodiment of the invention.

FIG. 2 is a schematic representation of a system 80 for extraction of the hydrocarbon rich stream 12 from the well formation 14 in accordance with another embodiment of the invention. The system 80 includes the downhole rotary separator 32 is configured to receive the well fluid 28 from the production zone 30 via the lateral leg 24 and separate the well fluid 28 to generate the hydrocarbon rich stream 12 and the first water stream 34. The downhole rotary separator 32 transmits the hydrocarbon rich stream 12 to the ESP 38 operatively coupled to the downhole rotary separator 32. The system 80 also includes the hydraulic motor 48 disposed within the well formation 14. The hydraulic motor 48 is operatively coupled to the downhole rotary separator 32. The system 80 includes a slip stream tubing 84 operatively coupled to the ESP 38 and the hydraulic motor 48. The slip stream tubing 84 is configured to obtain a portion 85 of the hydrocarbon rich stream 12 transferred from the downhole rotary separator 32 to the ESP 38. In such embodiments, the portion 85 of the hydrocarbon rich stream 12 is used as a drive fluid 82 to drive the hydraulic motor 48. The hydraulic motor 48 drives the downhole rotary separator 32 at a predetermined speed to generate the hydrocarbon rich stream 12 and the first water stream 34.

The system 80 further includes the control valve 62 configured to control the speed of the hydraulic motor 48 based on data received from at least one of the first sensor 56 and the second sensor 58. The control valve 62 is configured to control the pressure and the flow rate of the drive fluid 82 such as (i.e. the portion 85 of the hydrocarbon rich stream 12).

An exhaust hydrocarbon fluid tubing 88 is operatively coupled to the hydraulic motor 48 and the inlet 68 of the downhole rotary separator 32. The jet pump 36 located at the inlet 68 of the downhole rotary separator 32, is coupled to the exhaust hydrocarbon fluid tubing 88. The exhaust hydrocarbon fluid tubing 88 is configured to transfer an exhaust hydrocarbon fluid 86 from the hydraulic motor 48 to the downhole rotary separator 32 where the exhaust hydrocarbon fluid 86 is mixed with the well fluid 28 prior to separation.

As previously discussed herein, the downhole rotary separator 32 is configured to generate the hydrocarbon rich stream 12 which is transferred to the ESP 38. The ESP 38 transmits a portion 87 of the hydrocarbon rich stream 12 to the surface separator 46. The surface separator 46 is configured to generate oil 47 and the second water stream 50 from the hydrocarbon rich stream 12. The oil 47 generated from the hydrocarbon rich stream 12 is transported to a desired location. Further, a second water stream tubing 90 is operatively to the surface separator 46. The second water stream 50 is transferred back to the well formation 14 for disposal via the second water stream tubing 90.

The second water stream tubing 90 is operatively coupled to the first water stream tubing 42. The second water stream tubing 90 is used to transfer the second water stream 50 to the first water stream tubing 42 where the second water stream 50 is combined with the first water stream 34 prior to disposal in the subterranean water disposal zone 40. In the illustrated embodiment, the motive fluid tubing 66 is provided to connect the jet pump 36 located at the inlet 68 of the downhole rotary separator 32, to the first water stream tubing 42. In such embodiments, different substances may be added to the second water stream 50 prior to transferring the second water stream 50 to the first water stream tubing 42 for improving efficiency and reducing maintenance costs. In one example, anti-scaling chemicals may be added to the second water stream 50 prior to transferring the second water stream 50 to the first water stream tubing 42. The second water stream 50 including the anti-scaling chemicals is mixed with the first water stream 34 in the first water stream tubing 42. A portion of such mixture including the anti-scaling chemicals is transmitted to the downhole rotary separator 32 as the motive fluid 70 via the motive fluid tubing 66. Such a configuration enables cleaning of the downhole rotary separator 32 by reducing scaling in the downhole rotary separator 32.

Figure 3:
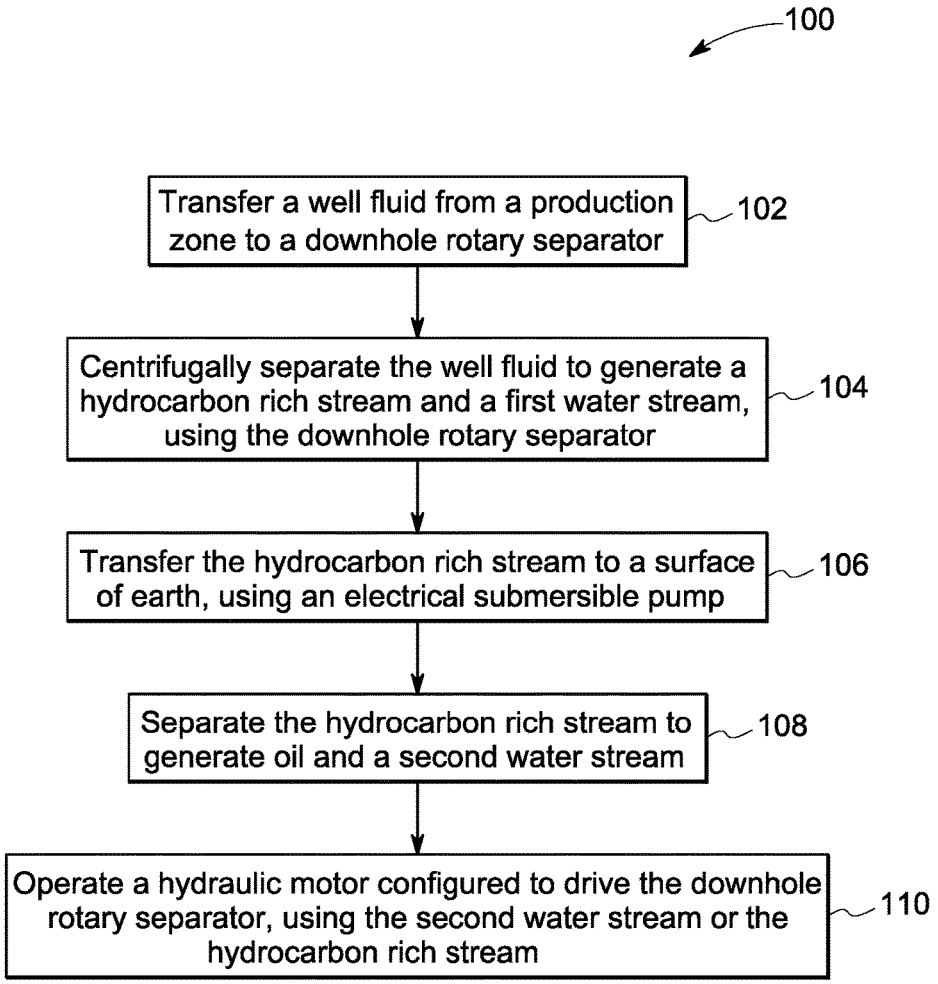
FIG. 3 is a flow chart representing steps involved in a method for extracting a hydrocarbon rich stream from a well formation in accordance with an embodiment of the invention.

FIG. 3 is a flow chart representing a plurality of steps involved in a method 100 for extracting a hydrocarbon rich stream from a well formation in accordance with an embodiment of the invention. The method 100 includes introducing a well fluid from a production zone to a downhole rotary separator in step 102. The method 100 also includes centrifugally separating the well fluid to generate a hydrocarbon rich stream and a first water stream, using the downhole rotary separator in step 104. The method 100 further includes transferring the hydrocarbon rich stream to a surface of the earth, using an ESP in step 106. The method 100 also includes separating the hydrocarbon rich stream to generate oil and a second water stream in step 108. The method 100 further includes operating a hydraulic motor which is configured to drive the downhole rotary separator, using the second water stream or the hydrocarbon rich stream in step 110. In embodiments where the second water stream is used for operating the hydraulic motor, an exhaust water obtained from the hydraulic motor is combined with the first water stream prior to disposing within the well formation. In another embodiment, a portion of the second water stream may be used as a motive fluid for performing additional functions in the system. In a specific embodiment, the portion of the second water stream may be used to reduce scaling in the downhole rotary separator by adding an anti-scaling chemical in the second water stream.

Furthermore, in embodiments including the hydrocarbon rich stream for operating the hydraulic motor, the hydrocarbon rich stream is obtained from the ESP as a slip stream from the ESP, where a portion of the hydrocarbon rich stream is used to operate the hydraulic motor. In such embodiments, an exhaust hydrocarbon fluid obtained from the hydraulic motor is transmitted to the downhole rotary separator and is combined with the well fluid prior to the step of separating the well fluid.

In some embodiments, the method further includes determining water content in the hydrocarbon rich stream transmitted to the ESP, using a first sensor. A flow rate of the hydrocarbon rich stream is determined, using a second sensor. Furthermore, a speed of the hydraulic motor is controlled based on data received from at least one of the first sensor and the second sensor to control a separation efficiency of the downhole rotary separator.

Embodiments of the present invention enable a user to control a speed of a hydraulic motor in a system for extracting hydrocarbon rich stream. As a result, the user can control a separation efficiency of a downhole rotary separator driven by the hydraulic motor. Furthermore, the system operates as a closed loop system for extraction of the hydrocarbon rich stream from the well formation and thereby allow disposal of water within the same well to reduce transportation costs for disposal of water. Furthermore, such a closed loop system enables distributed disposal of water which is separated from the well fluid, resulting in minimal risk of seismic activity. Moreover, use of a water stream or hydrocarbon rich stream to drive the hydraulic motor facilitates to reduce power consumptions costs.

It is to be understood that a skilled artisan will recognize the interchangeability of various features from different embodiments and that the various features described, as well as other known equivalents for each feature, may be mixed and matched by one of ordinary skill in this art to construct additional systems and techniques in accordance with principles of this specification. It is, therefore, to be understood that the appended claims are intended to cover all such modifications and changes as fall within the true spirit of the invention.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for extracting a hydrocarbon rich stream from a well formation, the system comprising:

a downhole rotary separator located within the well formation and configured to generate the hydrocarbon rich stream and a first water stream from a well fluid obtained from a production zone;

an electrical submersible pump disposed within the well formation and operatively coupled to the downhole rotary separator, wherein the electrical submersible pump is configured to transfer the hydrocarbon rich stream to a surface of earth;

a surface separator located on the surface of earth and operatively coupled to the electrical submersible pump, wherein the surface separator is configured to generate oil and a second water stream from the hydrocarbon rich stream; and a hydraulic motor disposed within the well formation and operatively coupled to the downhole rotary separator, wherein the hydraulic motor is configured to drive the downhole rotary separator using a drive fluid, wherein the drive fluid comprises the hydrocarbon rich stream or the second water stream.

2. The system of claim 1, wherein the downhole rotary separator comprises a centrifugal separator.

3. The system of claim 1, further comprising a first water stream tubing coupled to the downhole rotary separator, wherein the first water stream tubing is used to dispose the first water stream within the well formation.

4. The system of claim 3, further comprising a booster pump operatively coupled to the first water stream tubing, for increasing a pressure of the first water stream while disposing the first water stream within the well formation.

5. The system of claim 3, further comprising a second water stream tubing coupled to the surface separator and the hydraulic motor, wherein the second water stream tubing is configured to transfer the second water stream from the surface separator to the hydraulic motor for driving the downhole rotary separator.

6. The system of claim 5, further comprising an exhaust water tubing coupled to the hydraulic motor and the first water stream tubing, wherein the exhaust water tubing is used to combine an exhaust water obtained from the hydraulic motor with the first water stream, for disposal within the well formation.

7. The system of claim 1, further comprising a slip stream tubing coupled to the electrical submersible pump and the hydraulic motor, wherein the slip stream tubing is used to transfer the hydrocarbon rich stream from the electrical submersible pump to the hydraulic motor for driving the downhole rotary separator.

8. The system of claim 7, further comprising an exhaust hydrocarbon fluid tubing coupled to the hydraulic motor and an inlet of the downhole rotary separator, wherein the exhaust hydrocarbon fluid tubing is used to transfer an exhaust hydrocarbon fluid obtained from the hydraulic motor to the downhole rotary separator.

9. The system of claim 1, further comprising a jet pump operatively coupled to the downhole rotary separator, wherein the jet pump is configured to transfer the well fluid to the downhole rotary separator.

10. The system of claim 1, further comprising a first sensor operatively coupled to an outlet of the downhole rotary separator, wherein the first sensor is configured to determine a water content in the hydrocarbon rich stream.

11. The system of claim 10, further comprising a second sensor operatively coupled to an outlet of the downhole rotary separator, wherein the second sensor is configured to determine a flow rate of the hydrocarbon rich stream.

12. The system of claim 11, further comprising a control valve located at the surface of earth, wherein the control valve is configured to control a speed of the hydraulic motor based on data received from at least one of a first sensor and a second sensor.

13. A method for extracting hydrocarbons from a well formation, the method comprising:

transferring a well fluid from a production zone to a downhole rotary separator;

centrifugally separating the well fluid to generate a hydrocarbon rich stream and a first water stream, using the downhole rotary separator;

transferring the hydrocarbon rich stream to a surface of earth, using an electrical submersible pump;

separating the hydrocarbon rich stream to generate oil and a second water stream; and operating a hydraulic motor configured to drive the downhole rotary separator, using the second water stream or the hydrocarbon rich stream.

14. The method of claim 13, further comprising determining a water content in the hydrocarbon rich stream, using a first sensor.

15. The method of claim 14, further comprising determining a flow rate of the hydrocarbon rich stream, using a second sensor.

16. The method of claim 15, further comprising controlling a speed of the hydraulic motor based on an output received from at least one of a first sensor and a second sensor, to control a separation efficiency of the downhole rotary separator.

17. The method of claim 13, wherein operating the hydraulic motor comprises combining an exhaust water obtained from the hydraulic motor with the first water stream prior to disposing within the well formation, if the second water stream is used for operating the hydraulic motor.

18. The method of claim 13, wherein operating the hydraulic motor comprises transferring an exhaust hydrocarbon fluid obtained from the hydraulic motor to the downhole rotary separator and combining the exhaust hydrocarbon fluid with the well fluid prior to separating the well fluid, if the hydrocarbon rich stream is used for operating the hydraulic motor.

* * * * *